United States Patent [19]

Luce

[11] 4,090,426

[45] May 23, 1978

[54] CONTOUR GENERATOR FOR AUDIO SIGNAL

[75] Inventor: David A. Luce, Clarence Center, N.Y.

[73] Assignee: Norlin Music, Inc., Lincolnwood, Ill.

[21] Appl. No.: 588,689

[22] Filed: Jun. 20, 1975

[51] Int. Cl.[2] ..... G10H 1/02

[52] U.S. Cl. ..... 84/1.26; 84/1.13

[58] Field of Search ..... 84/1.01, 1.11, 1.19, 84/1.28, 1.13, 1.26

[56] References Cited

U.S. PATENT DOCUMENTS

| | | | |
|---|---|---|---|
| 3,415,941 | 12/1968 | Brand | 84/1.26 |
| 3,422,208 | 1/1969 | Barry | 84/1.26 |
| 3,509,263 | 4/1970 | Cordry | 84/1.26 |
| 3,543,281 | 11/1970 | Brand | 84/1.13 |
| 3,549,779 | 12/1970 | Buncer | 84/1.26 |
| 3,617,598 | 11/1971 | Woody, Jr. | 84/101 |
| 3,746,775 | 7/1973 | Uchiyama | 84/1.26 |
| 3,828,110 | 8/1974 | Colin | 84/1.01 |
| 3,848,142 | 11/1974 | Adachi | 84/1.26 |
| 3,886,836 | 6/1975 | Hiyoshi | 84/1.13 |
| 3,930,429 | 1/1976 | Hill | 84/1.01 |

*Primary Examiner*—Robert K. Schaefer
*Assistant Examiner*—Vit N. Miska
*Attorney, Agent, or Firm*—Ronald J. Kransdorf

[57] ABSTRACT

A circuit for providing a predetermined contour for the audio signal produced by an electronic musical instrument. A reference potential which is changed under predetermined conditions, and an unidirectional reference current which may also change under some or all of the predetermined conditions, are applied to a circuit which changes the amplitude of the audio signal from its existing level to a level determined by the reference potential at a rate which is determined by the reference current.

12 Claims, 2 Drawing Figures

CONTOUR GENERATOR FOR AUDIO SIGNAL

BACKGROUND

1. Field of the Invention

This invention relates to electronic musical instruments, and more particularly to an improved contour generating circuit for use in such instruments.

2. The Prior Art

In electronic musical instruments such as electronic organs and synthesizers, the sound which is obtained when a particular note or combination of notes is played is determined by a number of factors including the frequency of the audio signal, the shape of the signal (i.e., harmonic content thereof) and the contour (i.e., shape of the envelope) to the signal. The contour of the signal determines the amplitude of the signal at each point in time during the period that the note is being sounded. Typically, the amplitude of the signal rises to a predetermined maximum value over a predetermined time interval (attacktime), starting when a key or switch of the instrument is operated, remains at this maximum level, or decreases over a predetermined time interval to a predetermined sustain level, while the key or switch is operated, and then decays over a predetermined time interval when the key is released or the switch opened. The attack and decay characteristics may have any desired shape, a linear or an exponential characteristic being the two most common.

In devices of the type indicated above, the attack and decay slopes have normally been controlled from a current source, a constant current source being required for linear slope characteristics. These current sources have had to be bi-directional in order to permit control of both attack and decay slopes. Further, only one type of slope characteristic (i.e., linear or exponential) has been available with any given contour generator circuit, a completely separate circuit being required if a capability for different slope characteristics is required. The factors indicated above have made it difficult to provide a voltage control for the slope of the contour and have generally caused these circuits to be relatively complicated and expensive.

A need therefore exists for a relatively simple and inexpensive contour generating circuit for an audio signal which permits the slope for both attack and decay to be controlled by currents flowing in the same direction and thus permits the slope to be voltage controlled. Such a circuit should also permit different attack and decay curve characteristics, such as for example linear or exponential characteristics, to be achieved utilizing basically the same circuit.

SUMMARY OF THE PRESENT INVENTION

In accordance with the above, this invention provides a circuit for producing a predetermined contour for the audio signal generated by an electronic musical instrument. The circuit includes a means for providing a reference potential of a predetermined value, means for providing a unidirectional reference current of a predetermined value, and a means for changing the amplitude of the audio signal from its existing level to a level determined by the reference potential, the change occuring at a rate determined by the reference current. A means is provided which is operative under predetermined conditions for changing the value of the reference potential and a means is also provided which is operative under at least some of the predetermined conditions for also changing the value, but not the direction, of the reference current. The means for changing the amplitude of the audio signal includes, for preferred embodiments of the invention, a capacitor, the potential across which is utilized to control the amplitude of the audio signal, and a means for providing a charging current for the capacitor which is equal to a function of the difference between the reference potential and the potential across the capacitor times the reference current. The maximum value of the charging current is equal to the reference current. The capacitor is permitted to effectively discharge through the means for providing charging current when the difference between the reference potential and the potential across the capacitor is negative. For preferred embodiments, the means of providing charging current also include first means operative for decreasing the charging current as the difference between the reference potential and the potential across the capacitor decreases, permitting the potential across the capacitor to change at a substantially exponential rate, second means operative for causing the charging current to remain substantially constant at its maximum value as the difference between the reference potential and the potential across the capacitor decreases, permitting the potential across the capacitor to change at a substantially linear rate, and means for selecting either the first means or the second means to be operative at any given time.

The foregoing and other objects, features and advantages of the invention will be apparent from the following more particular description of a preferred embodiment of the invention as illustrated in the accompanying drawings.

DETAILED DESCRIPTION

Figures 1, 2:
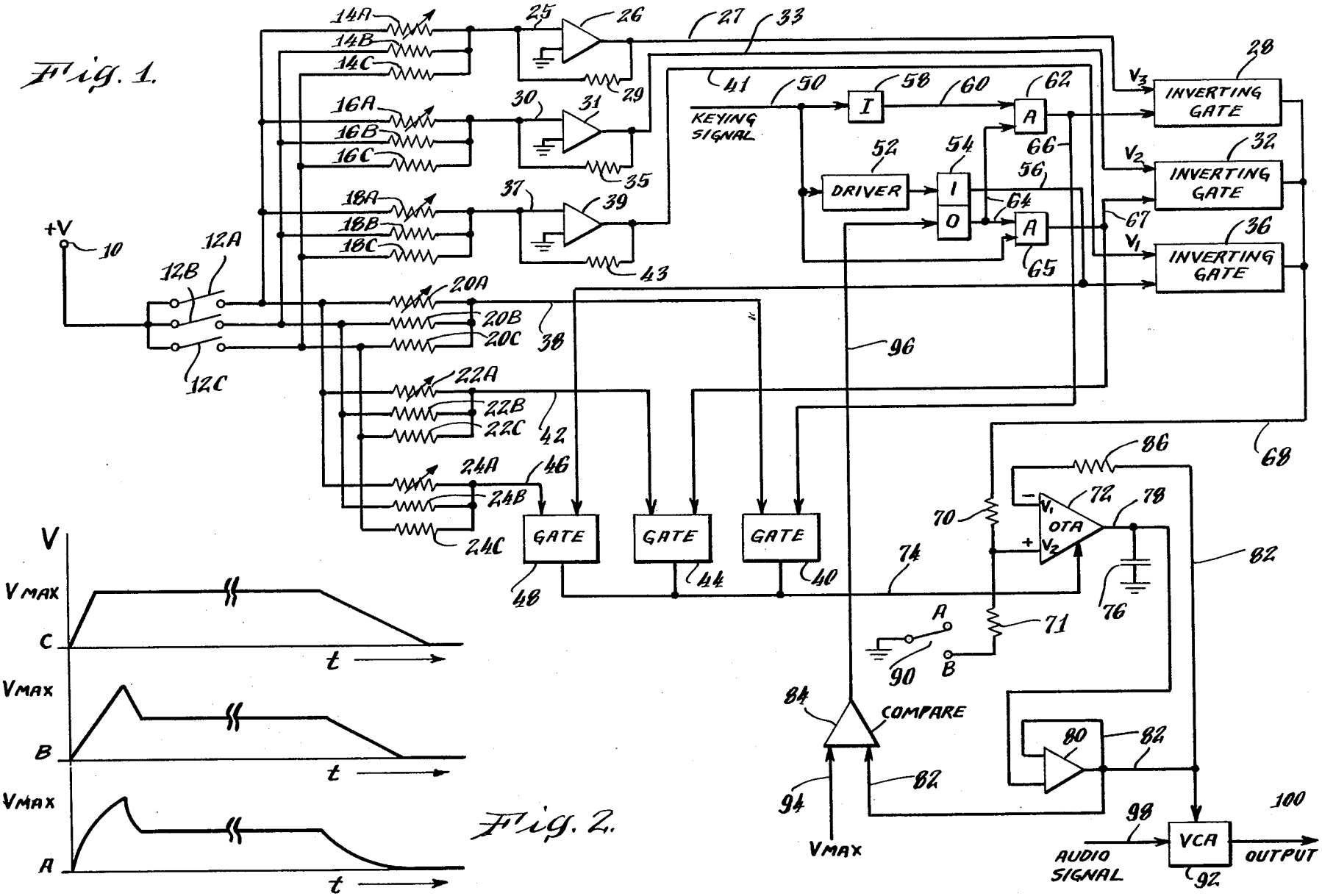
FIG. 1 is a semi-block schematic diagram of a circuit of a preferred embodiment of the invention.
FIG. 2 is a diagram illustrating various contours for an audio signal which may be achieved utilizing the circuit of FIG. 1.

Referring now to FIG. 1, it is seen that a positive voltage from voltage source 10 is applied to one side of three switches 12A, 12B, and 12C. The other side of switch 12A is connected to one side of variable resistors 14A, 16A, 18A, 20A, 22A, and 24A. The other side of switch 12B is connected to one side of resistors 14B, 16B, 18B, 20B, 22B and 24B, while the other side of switch 12C is connected to one side of resistors 14C, 16C, 18C, 20C, 22C and 24C. The other side of variable resistor 14A and of resistors 14B and 14C are connected through a common line 25 to the negative input terminal of an operational amplifier 26. Output line 27 from amplifier 26 is connected as one input to inverting gate 28 and through feedback resistor 29 to the amplifiers negative input. Similarly, the other side of each of the resistors 16 are connected through a common line 30 to the negative input of an operational amplifier 31 and the other side of each of the resistors 18 are connected through a common line 37 to the negative input of an operational amplifier 39. Output line 33 from amplifier 31 is connected as one input to inverting gate 32 and through feedback resistor 35 to the amplifiers negative input. Output line 41 from amplifier 39 is connected as one input to inverting gate 36 and through feedback resistor 43 to the amplifier's negative input. The positive input of each of the amplifiers 26, 31, and 39 is connected to ground. The output from each of the amplifiers 26, 31 and 39 is a negative potential which varies as a function of the corresponding resistance 14, 16, 18 which is switched into the circuit and of the feedback resistor. The other side of variable resistor 20A and of resistors 20B and 20C are connected through a conmon line 38 to one input of a gate 40, the other side of variable resistor 22A and of resistors 22B and 22C are connected through a common line 42 to one input of a gate 44 and the other side of variable resistor 24A and of resistors 24B and 24C are connected through a line 46 to one input of a gate 48.

When a key (not shown) on the keyboard of a musical instrument is depressed, or a switch on the instrument is otherwise closed, the potential on keying signal line 50 becomes positive. This positive potential is converted into a pulse by driver 52, the output from the driver being applied to set flip-flop 54 to its one state. Output line 56 from the one side of flip-flop 54 is connected as the other input to gates 36 and 48. When the key on the keyboard is released, the potential on line 50 returns to a ground or zero potential. When this occurs, inverter 58 generates a positive output on line 60 which is connected as one input to AND gate 62. The other input to AND gate 62 is a zero-side output line 64 from flip-flop 54. Line 64 is also connected as one input to AND gate 65, the other input to this AND gate being line 50. Output line 67 from AND gate 65 is connected as the other input to gates 32 and 44. The output from AND Gate 62 on line 66 is connected as the other input to gates 28 and 40.

The outputs from gates 28, 32 and 36 are connected through a common line 68 and a resistor 70 to both the positive input of an operational transconductance amplifier (OTA) 72, and through a resistor 71, to the B terminal of a switch 90. The value of resistor 70 is many times greater (for example 100 times greater) than the value of resistor 71. The blade of switch 90 is connected to ground. The outputs from gates 40, 44, and 48 are connected through a common line 74 to the control input of the OTA. A capacitor 76 is connected between output line 78 from OTA 72 and ground, the capacitor thus being connected to be charged by the current appearing on line 78. The potential across capacitor 76 is applied to one input of operational amplifier 80. Output line 82 from amplifier 80 is connected (a) to the other input of amplifier 80, (b) as one input to compare circuit 84, (c) through resistor 86 to both the negative input of OTA 72, and through resistor 88, to ground and (d) as the control input to voltage controlled amplifier (VCA) 92. The resistance of resistor 86 is many times greater (for example, 100 times greater) than the resistance of resistor 88; therefore only a small fraction of the potential appearing on line 82 is applied to the negative input terminal of the OTA.

The other input to compare circuit 84 is a line 94 which has applied thereto a voltage which is equal to the maximum control potential appearing on line 82. When the inputs to compare circuit 84 are equal, the circuit generates an output on line 96 which is applied to the zero-side input of flip flop 54.

The audio signal, the contour of which is to be controlled by the circuit of this invention, is applied through line 98 to the input of VCA 92. The desired output from the circuit is obtained on output line 100 from VCA 92.

In operation, only one of the switches 12 will be closed at any given time. When switch 12A is closed, the voltages applied to one input of each of the voltage gates 28, 32 and 36 may be varied and the current applied to each of the current gates 40, 44, and 48 may be varied. When preset switches 12B or 12C are closed, a predetermined set of voltages are applied to the voltage gates and a predetermined set of currents are applied to the current gates. Thus, when switches 12B or 12C are closed, a predetermined contour for the audio waveform appearing on line 98 is obtained, while when switch 12A is closed, any one or more of the variable resistors may be adjusted to provide a selected contour for the audio waveform.

With the circuit of FIG. 1, nothing happens until a key or switch is operated causing a positive potential to appear on line 50. When this happens, driver 52 generates an output pulse which switches flip-flop 54 to its one state. The resulting output signal on line 56 conditions gate 36 to pass the voltage output from amplifier 39, the magnitude of this voltage depending on the selected one of the resistors 18 (this selection depending on which of the switches 12 is closed) through line 68 and resistor 70 to the positive input of OTA 72. The signal on line 56 also conditions gate 48 to pass the current appearing on line 46, this current depending on which of the resistors 24 is selected, through line 74 to the control input of the OTA. The OTA, which may, for example, be RCA CA3080 circuit, has the following characteristics:

1. $I_{out} = I_{in}(V_+ - V_-)$
2. $I_{out\,max} = I_{in}$
3. When $(V_+ - V_-)$ is negative, current flows through the OTA in the opposite direction from when this function is positive.

Assume initially that switch 90 is in its A position as shown. Under this condition, the voltage divider path through resistor 71 is open circuited causing essentially the full potential on line 68 to be applied to the positive terminal of OTA 72. Since the feedback potential on line 82 is voltage divided so only a small portion of it is applied to the negative input of to OTA, the potential applied to the positive input is large enough so that the function $(V_+ - V_-)$ has an absolute value greater than one until the potential across capacitor 76 is nearly equal to the reference potential on line 68. This results in the output current on line 78 being substantially constant at $I_{out\,max}$. With a substantially constant current on line 78, capacitor 76 charges linearly until the charge across the capacitor is almost equal to the potential applied to the positive terminal of the OTA. Since the charging current for the capacitor is substantially equal to the input current on line 74, the slope of the curve is determined by this current. As the charge across capacitor 76 increases, the output on line 82 from operational amplifier 80 similarly increases, the potential on line 82 being at all times substantially equal to the charge across the capacitor. Amplifier 80 serves as a high impedance device to prevent charge from leaking from the capacitor. Line B of FIG. 2 shows a typical attack characteristic when the circuit is operating in this mode.

When the potential across the capacitor, and thus on line 82, reaches the desired V max, the inputs to compare circuit 84 are equal, resulting in an output on line 96 which is applied to reset flip flop 54 to its zero state. When this occurs, gates 36 and 48 are deconditioned and the potential now appearing on zero-side output line 64 from flip flop 54 fully conditions AND gate 65 to generate an output on line 67 which is applied to condition gate 32 and 44. The voltage on output line 33 from amplifier 31 (which voltage is dependent on the selected one of the resistors 16) is thus passed through gate 32 line 68 and resistor 70 to the positive input of OTA 72, and the current from the selected one of the resistors 22 is passed through line 42, gate 44, and line 74 to the control input of the OTA. If the new potential is the same as the old potential (i.e., is the same as the potential applied to gate 36), than both inputs to OTA 72 remain the same and there is no output current therefrom. A typical characteristic curve under these conditions is shown on line C of FIG. 2. If the new potential is less than the potential applied to gate 36, than $(V_+ - V_-)$ will be negative, and capacitor 76 will be permitted to discharge through the OTA until the potentials applied to the OTA's inputs are again equal. The rate at which the capacitor is permitted to discharge is determined by the control current appearing on line 74. This control current may be the same as, or different from, the control current applied to gate 48. A typical contour curve where the sustain potential is less than the maximum potential is shown on line B of FIG. 2.

Once the desired sustain potential is achieved across capacitor 76, nothing further happens with the circuit until the key or switch is released causing the potential on line 50 to return to ground. When this happens, inverter 58 generates an output on line 60 which, in conjunction with the signal on line 64, fully conditions AND gate 62 to generate an output on line 66 which is applied as a conditioning input to gates 28 and 40. The keying signal no longer being present on line 50, AND gate 65 is deconditioned, causing gates 32 and 44 to be deconditioned. The potential on line 27 which is applied to gate 28 would normally be at or near ground potential. The current applied to gate 40 could again be the same or different than that applied to gates 44 and/or 48. If this current is relatively low, the rate at which capacitor 76 is permitted to discharge through OTA 72 until the OTA's voltage inputs are again equal will be relatively slow as shown on line C of FIG. 2, while if this current is higher, the rate of discharge will be more rapid. Once the inputs to OTA 72 are equal, discharging of capacitor 76 terminates and the control potential applied through line 82 to VCA 92 remains constant at or near zero until the next key or switch on the instrument is operated.

If switch 90 is in its B position rather than in its A position, the operation of the circuit is substantially identical to that described above except that the potential on line 68 is voltage divided with most of the drop occurring across resistor 70 so that only a small fraction of the reference potential on line 68 (this fraction preferably being the same fraction as that of the feedback potential applied to the $V_-$ terminal) is applied to the $V_+$ terminal of OTA 72. With these low-value inputs, the voltage difference across the OTA can be maintained at an absolute value of less than one over substantially entire operating range of the circuit. Under these conditions, the output current from the OTA decreases, resulting in capacitor 76 being charged with a substantially exponential characteristic. When the output current is effectively negative, the capacitor 76 discharges through the OTA with a substantially exponential characteristic. Line A of FIG. 2 illustrates the contour for the audio signal under these conditions for substantially the same voltage and current inputs as those for line B of FIG. 2.

While for the preferred embodiment of the invention described above, three different currents have been shown as being available, a lesser number of different currents could be utilized. Thus line 42 could, for example, be connected as an input to both gates 44 and 48, or gate 48 could be eliminated completely, where the same slope is desired for both the attack characteristic and the decay-to-sustain level characteristic. Where a characteristic such as that shown on line C of FIG. 2 is desired, gates 32 and 44 and voltage and current sources 16 and 20 respectively and related circuitry could be eliminated. Conversely, a contour which rises in two steps and falls in one or more steps; a contour which rises to a predetermined level, is sustained at that level, and then rises again before decaying; or any other desired contour characteristic can be achieved, utilizing the teachings of this invention, by providing suitable reference voltage and current sources and by causing these sources to be gated onto lines 68 and 74 under desired conditions.

Thus, while the invention has been particularly shown and described above with reference to a preferred embodiment thereof, the foregoing and other changes in form and detail may be made therein without departing from the spirit and scope of the invention.

What is claimed is:

1. A circuit for providing a predetermined contour for the audio signal produced by an electronic musical instrument comprising:

means for providing a reference potential of a predetermined value;

means for providing a unidirectional reference current of a predetermined value;

means for increasing or decreasing the amplitude of said audio signal from its existing level to a level determined by said reference potential, the change occurring at a rate determined by said reference current, the direction of said reference current being the same regardless of whether said amplitude is increasing or decreasing; and means operative when it is desired to increase or decrease the amplitude of said audio signal for making an appropriate change in the value of said reference potential.

2. A circuit as claimed in claim 1 including means operative under certain predetermined conditions for also changing the value, but not the direction, of said reference current.

3. A circuit as claimed in claim 1 wherein said means for increasing or decreasing the amplitude of said audio signal includes means for permitting said change to occur at either a linear rate or an exponential rate.

4. A circuit as claimed in claim 1 wherein said means for increasing or decreasing the amplitude of said audio signal includes a capacitor, the potential across which is utilized to control the amplitude of said audio signal, and means for providing a charging current for said capacitor which is equal to the difference between the reference potential and the potential across the capacitor times the reference current, the maximum value of the charging current being equal to the reference current, said capacitor effectively discharging through said means for providing charging current when the difference between the reference potential and the potential across the capacitor is negative.

5. A circuit as claimed in claim 4 wherein said means for providing charging current is an operational transconductance amplifier.

6. A circuit as claimed in claim 4 wherein said means for providing a charging current includes first means operative for decreasing the charging current as the difference between the reference potential and the potential across the capacitor decreases, permitting the potential across the capacitor to change at a substantially exponential rate, second means operable for causing the charging current to remain substantially constant at its maximum value as the difference between the reference potential and the potential across the capacitor decreases, permitting the potential across the capacitor to change at a substantially linear rate, and means for selecting either said first means or said second means to be operative at any given time.

7. A circuit as claimed in claim 6 wherein said means for providing a charging current includes means operative when said first means is selected for voltage dividing the reference potential so as to assure that the absolute value of the function of the difference between the reference potential and the potential across the capacitor is normally less than one.

8. A circuit as claimed in claim 1 wherein said electronic musical instrument has a keyboard; and wherein said means for changing the value of the reference potential includes means operative when a key is depressed for changing the reference potential to its peak value, and means operative when a key is released for changing the reference potential to its minimum value.

9. A circuit as claimed in claim 8 wherein said means for changing the value of the reference potential includes means operative when the audio signal reaches the level determined by the peak value of the reference potential for changing the reference potential to a sustain value, the sustain value being a value between the peak value and the minimum value.

10. A circuit as claimed in claim 8 including means operative when a key is depressed or released for changing the value, but not the direction of the reference current.

11. A circuit as claimed in claim 2 wherein the value of said reference current is voltage controlled.

12. A circuit as claimed in claim 11 including a plurality of switches; and means responsive to the closing of each of said switches for generating a set of reference currents; and wherein said means for changing the value of said reference current includes means for causing a different reference current of the selected set to be utilized in response to each of said predetermined conditions.

* * * * *